US008522374B2

(12) United States Patent
Sousa et al.

(10) Patent No.: US 8,522,374 B2
(45) Date of Patent: Sep. 3, 2013

(54) INFANT-CARE FURNITURE

(75) Inventors: David Sousa, Tiverton, RI (US); John Huntley, Philadelphia, PA (US); Michael Degrace, Lancaster, PA (US); Gregg Espenshade, Navron, PA (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 12/943,794

(22) Filed: Nov. 10, 2010

(65) Prior Publication Data

US 2012/0110730 A1 May 10, 2012

(51) Int. Cl.
*A47B 83/00* (2006.01)

(52) U.S. Cl.
USPC ..... 5/2.1; 5/93.1; 5/99.1

(58) Field of Classification Search
USPC ..... 5/95, 97, 99.1, 187, 98.3, 122, 186.1, 5/2.1, 93.1, 93.2, 96, 98.1, 131, 158
See application file for complete search history.

(56) References Cited

U.S. PATENT DOCUMENTS

| | | | | | |
|---|---|---|---|---|---|
| 1,391,566 | A | * | 9/1921 | Musselman | 5/2.1 |
| 1,703,372 | A | * | 2/1929 | Tilton | 256/25 |
| 1,719,614 | A | * | 7/1929 | McIntosh | 108/49 |
| D110,892 | S | * | 8/1938 | Davis | D6/384 |
| D144,670 | S | * | 5/1946 | Adolf | D6/384 |
| 2,412,005 | A | * | 12/1946 | Parsons | 5/93.1 |
| 2,501,309 | A | * | 3/1950 | Braver | 5/308 |
| D158,038 | S | * | 4/1950 | Barmache et al. | D6/384 |
| 2,533,983 | A | * | 12/1950 | Weigle et al. | 5/2.1 |
| 2,536,731 | A | * | 1/1951 | Douglas | 4/547 |
| 2,553,087 | A | * | 5/1951 | Hanson | 5/93.1 |
| 2,652,574 | A | * | 9/1953 | Toomey | 5/11 |
| 2,662,231 | A | * | 12/1953 | King | 5/2.1 |
| 2,721,336 | A | * | 10/1955 | Becker | 5/2.1 |
| 3,400,829 | A | * | 9/1968 | Youngson | 211/119.006 |
| 3,427,666 | A | * | 2/1969 | Saxe | 5/2.1 |
| 3,644,947 | A | * | 2/1972 | Padera | 5/100 |
| D252,898 | S | * | 9/1979 | Wald | D6/331 |
| D260,827 | S | * | 9/1981 | Sommer | D6/384 |
| 4,593,873 | A | * | 6/1986 | Nelson | 248/98 |
| 4,633,537 | A | * | 1/1987 | Smith | 5/2.1 |
| D346,708 | S | * | 5/1994 | Baer | D6/384 |
| D382,718 | S | * | 8/1997 | Mariol | D6/331 |
| 5,754,995 | A | * | 5/1998 | Behrendt | 5/201 |
| 5,813,064 | A | * | 9/1998 | Hartenstine | 5/99.1 |
| 5,918,329 | A | | 7/1999 | Huang | |
| 5,947,277 | A | * | 9/1999 | Sherman | 206/216 |
| 6,125,483 | A | * | 10/2000 | Stroud et al. | 5/99.1 |
| 6,173,462 | B1 | * | 1/2001 | Huang et al. | 5/655 |
| 6,192,535 | B1 | * | 2/2001 | Warner et al. | 5/93.1 |
| 6,314,892 | B1 | * | 11/2001 | Favini | 108/115 |
| 6,332,231 | B1 | * | 12/2001 | Wang | 5/507.1 |
| 6,543,070 | B2 | * | 4/2003 | Longenecker et al. | 5/93.1 |
| 6,684,420 | B2 | * | 2/2004 | Koenig et al. | 5/93.1 |
| 6,735,796 | B2 | * | 5/2004 | Warner et al. | 5/99.1 |
| 6,952,849 | B2 | * | 10/2005 | Pacella | 5/658 |

(Continued)

*Primary Examiner* — Pete Cuomo
*Assistant Examiner* — Myles Throop
(74) *Attorney, Agent, or Firm* — Barnes & Thornburg LLP

(57) ABSTRACT

Infant-care furniture includes a playyard and a playyard accessory unit coupled to the playyard. The playyard accessory unit includes an accessory frame and a case coupled to the accessory frame, and further includes a changer shell coupled to an upper pedestal section that is coupled to the playyard. The accessory unit further includes a storage shell and a hamper shell coupled to the changer shell.

32 Claims, 6 Drawing Sheets

(56) References Cited

U.S. PATENT DOCUMENTS

| | | | | |
|---|---|---|---|---|
| 6,959,462 | B2 * | 11/2005 | Chen | 5/93.1 |
| 7,043,779 | B2 * | 5/2006 | Mendenhall et al. | 5/99.1 |
| 7,228,575 | B2 * | 6/2007 | Chen | 5/93.2 |
| 7,263,729 | B2 * | 9/2007 | Paesang et al. | 5/98.1 |
| 7,418,745 | B2 * | 9/2008 | Paesang et al. | 5/98.1 |
| 7,458,114 | B2 * | 12/2008 | Troutman | 5/93.1 |
| 7,581,269 | B2 * | 9/2009 | Chen et al. | 5/655 |
| 7,752,693 | B2 * | 7/2010 | Espenshade | 5/723 |
| 7,908,686 | B2 * | 3/2011 | Clapper et al. | 5/93.1 |
| 7,950,081 | B2 * | 5/2011 | Chen et al. | 5/93.2 |
| 8,011,036 | B2 * | 9/2011 | Tuckey | 5/93.1 |
| 2002/0078499 | A1 * | 6/2002 | Cheng | 5/95 |
| 2002/0114480 | A1 * | 8/2002 | Chen et al. | 381/333 |
| 2002/0157180 | A1 * | 10/2002 | Koenig et al. | 5/93.1 |
| 2003/0126681 | A1 * | 7/2003 | Tharalson et al. | 5/93.2 |
| 2003/0177575 | A1 * | 9/2003 | Cheng et al. | 5/93.1 |
| 2004/0133977 | A1 * | 7/2004 | Rimbau Vidal | 5/98.3 |
| 2004/0139527 | A1 * | 7/2004 | Damir et al. | 2/83 |
| 2004/0237191 | A1 * | 12/2004 | Clapper et al. | 5/99.1 |
| 2004/0244109 | A1 * | 12/2004 | Koenig et al. | 5/93.1 |
| 2005/0242248 | A1 * | 11/2005 | Ryan | 248/95 |
| 2006/0080776 | A1 * | 4/2006 | Clapper et al. | 5/93.1 |
| 2006/0218725 | A1 * | 10/2006 | Carpenter et al. | 5/93.1 |
| 2006/0225204 | A1 * | 10/2006 | Bretschger et al. | 5/93.1 |
| 2007/0001488 | A1 * | 1/2007 | Xiang | 297/140 |
| 2007/0061962 | A1 * | 3/2007 | Pascual | 5/93.1 |
| 2008/0235867 | A1 * | 10/2008 | Chen | 5/93.1 |
| 2008/0271243 | A1 * | 11/2008 | Burkholder et al. | 5/93.2 |
| 2009/0064409 | A1 * | 3/2009 | Carpenter et al. | 5/2.1 |
| 2009/0113622 | A1 * | 5/2009 | Hartenstine | 5/2.1 |
| 2009/0113624 | A1 * | 5/2009 | Tuckey | 5/93.1 |
| 2009/0260155 | A1 * | 10/2009 | Troutman | 5/98.1 |
| 2010/0132115 | A1 * | 6/2010 | Hsu | 5/98.1 |
| 2010/0162484 | A1 * | 7/2010 | Thomas et al. | 5/93.2 |
| 2010/0229301 | A1 * | 9/2010 | Arnold et al. | 5/93.2 |
| 2011/0174811 | A1 * | 7/2011 | Sabounjian | 220/9.2 |
| 2011/0197356 | A1 * | 8/2011 | Clapper et al. | 5/2.1 |

* cited by examiner

INFANT-CARE FURNITURE

BACKGROUND

The present disclosure relates to juvenile furniture, and particularly to playyards. More particularly, the present disclosure relates to accessories for playyards.

SUMMARY

Infant-care furniture in accordance with the present disclosure includes a playyard having a playyard frame and a covering coupled to the playyard frame. The infant-care furniture also includes a playyard accessory unit coupled to the playyard frame.

In illustrative embodiments, the playyard accessory unit includes an accessory frame coupled to the playyard frame and a case comprising separate, storage, hamper, and charger shells made of a fabric material. The case is draped over and coupled to the accessory frame to create storage, hamper, and infant changer modules arranged to lie adjacent to the playyard.

An illustrative accessory frame in accordance with the present disclosure includes an upper pedestal section coupled to a top rail system in the playyard frame. The upper pedestal system is configured to support the changer shell in a position above one end of the playyard. The upper pedestal section includes a changer rim coupled to the changer shell and two changer rim support legs coupled to separate top corners of the playyard frame and arranged to extend upwardly away from the playyard frame to mate with the changer rim and support the changer shell above one end of the playyard.

The illustrative accessory frame also includes a lower foundation section coupled to a playyard floor system included in the playyard frame. This lower foundation section extends from a corner foot included in the playyard floor system outwardly away from the playyard. An upright auxiliary leg included in the accessory frame has a lower end coupled to a free end of the lower foundation section and an upper end coupled to the changer rim. The auxiliary leg is also coupled to the storage shell so that the storage shell is tethered to the accessory frame.

In illustrative embodiments, the storage shell includes several open shelves. The storage and hamper shells are arranged normally to extend downwardly from an underside of the changer shell and lie in side-by-side relation to one another next to one end of the playyard. The hamper shell can be separated from the changer and storage shells by means of a zipper or other suitable releasable fastener.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 7 shows the changer shell included in the case mounted on the changer rim before the first and second changer rim support legs coupled to the changer rim are mounted on corner pieces included in a top rail system of a companion playyard and also shows the storage shell arranged to hang downwardly from an underside of the changer shell;

FIG. 8 shows that the S-shaped connector rail has been coupled to the playyard by inserting the left end of the connector rail into the rail receptacle included in the playyard frame and located near one of the corner feet included in the playyard frame;

FIG. 9 shows that a portion of the accessory frame has been mounted on two of the corner pieces included in a top rail system provided in the playyard frame to position the changer and storage shells alongside one end of the playyard while an installer holds the infant changer module in a level orientation with one hand while inserting the auxiliary leg into a sleeve formed in the storage shell with the other hand;

FIG. 10 shows that a lower end of the auxiliary leg has been inserted into a lower leg receiver formed in the foot coupled to the right end of the S-shaped connector rail and that an upper end of auxiliary leg has been inserted into an upper leg receiver formed in one of the rim mounts coupled to the changer rim so that the auxiliary leg is installed to complete assembly of the accessory frame and to hold the infant changer module in a level orientation and showing that the removable hamper shell can be coupled to the changer and storage shells at this stage of assembly using a zipper-style fastener (the hamper shell can also be coupled to the changer and storage shells at the stage shown in FIG. 7)

DETAILED DESCRIPTION

Figure 1:
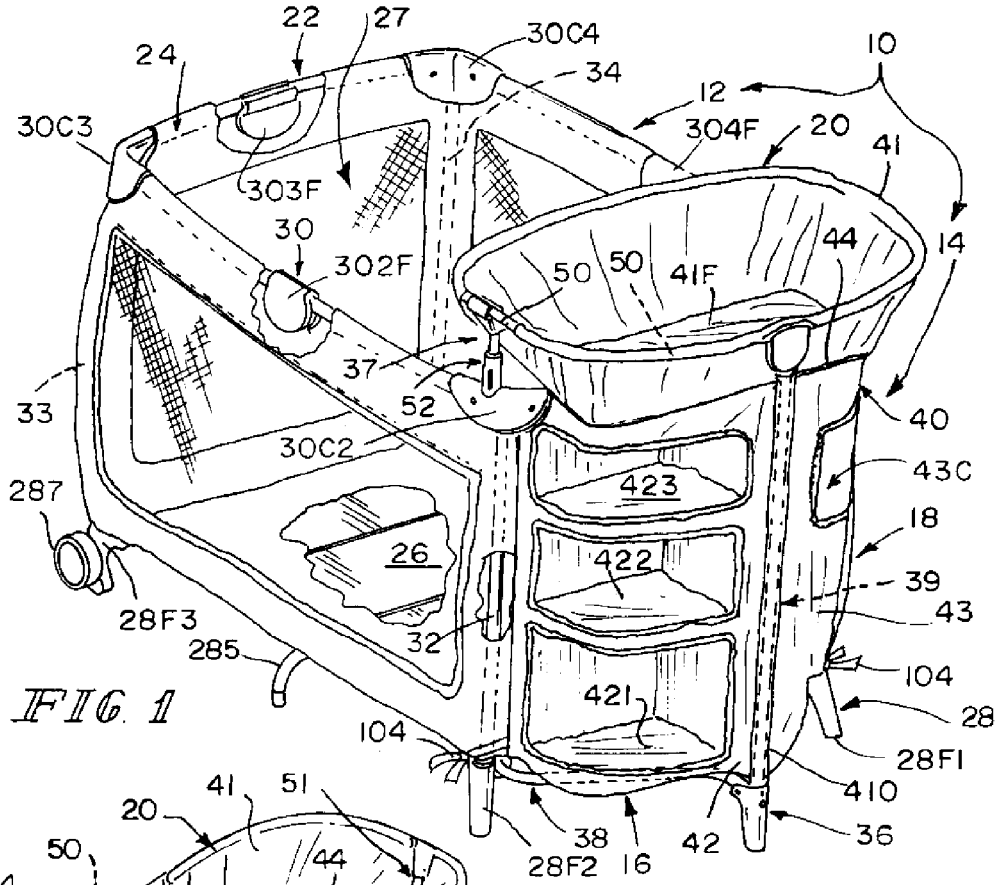
FIG. 1 is a perspective view of infant-care furniture in accordance with the present disclosure showing a playyard accessory unit coupled to a playyard and configured to include an infant changer module above one end of the playyard, a storage module under one end of the infant changer module, and a hamper module under an opposite end of the infant changer module.

Infant-care furniture 10 includes a playyard 12 and a playyard accessory unit 14 coupled to playyard 12 as shown, for example, in FIGS. 1-4. Playyard accessory unit 14 comprises storage, hamper, and infant changer modules 16, 18, and 20. Illustrative components included in playyard accessory unit 14 can be assembled in the field by a caregiver as suggested in FIGS. 7-10 to couple playyard accessory unit 14 to a first end of playyard 12 so that infant changer module 20 lies above playyard 12 and storage and hamper modules 16, 18 lie in side-by-side relation to one another and alongside the first end of playyard 12 and under an outer portion of changer module 20.

Figure 2:
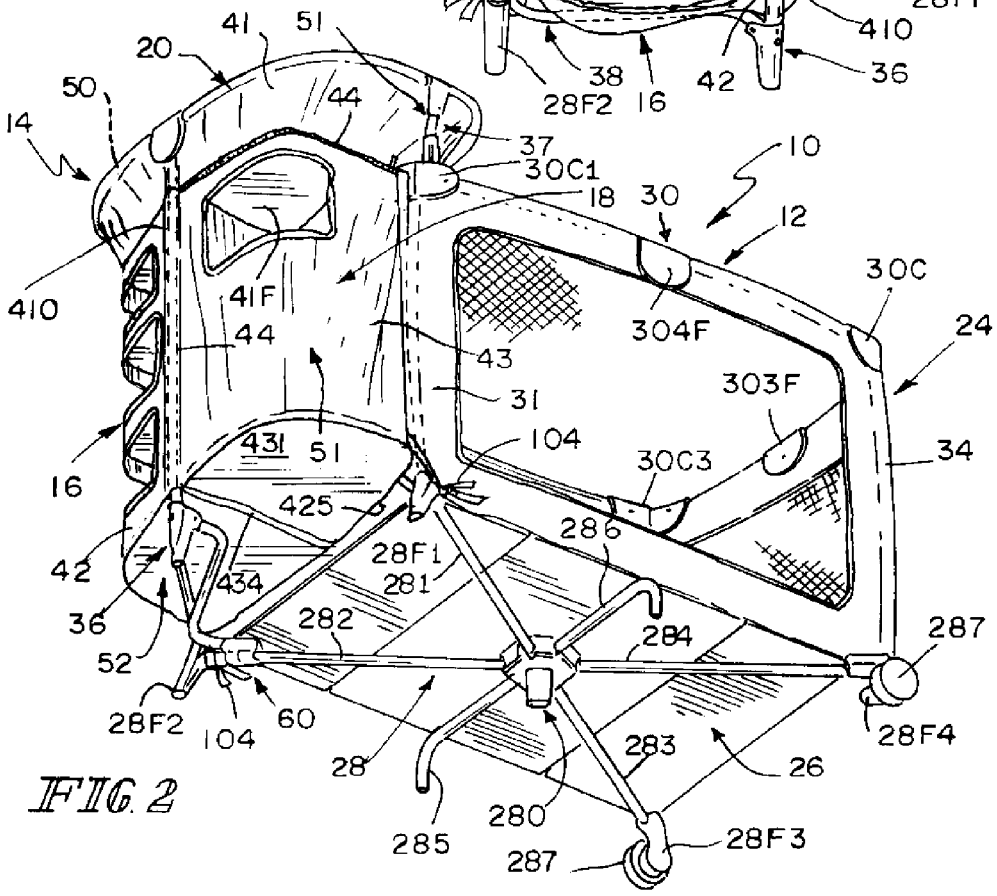
FIG. 2 is another perspective view of the infant-care furniture of FIG. 1 showing a playyard floor support system included in the playyard.
Figure 3:
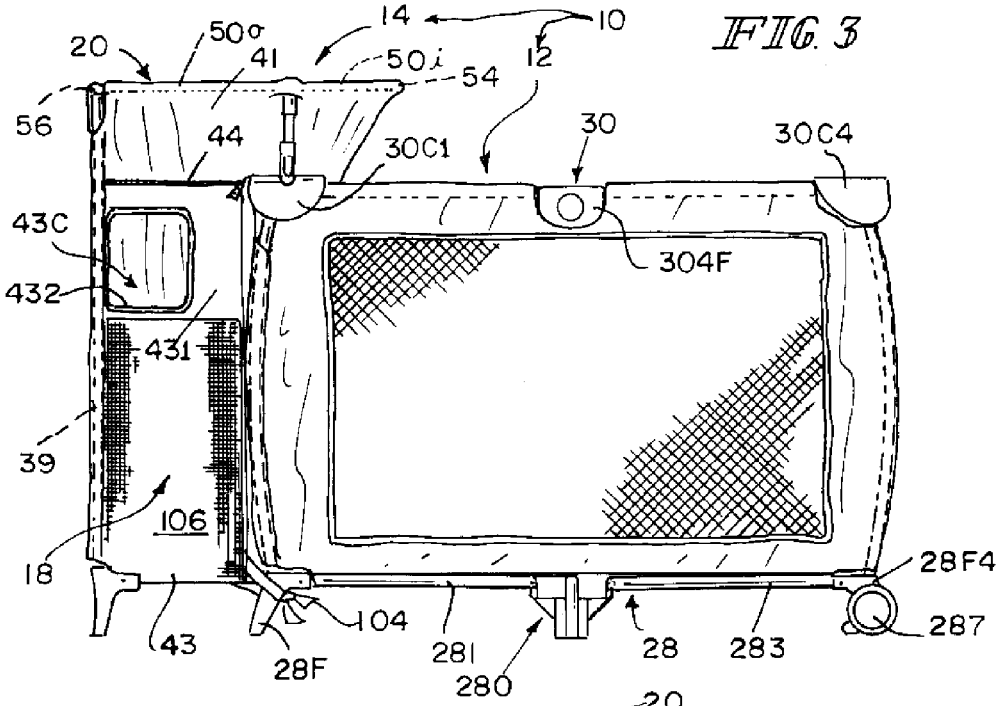
FIG. 3 is a side elevation view of the infant-care furniture of FIGS. 1 and 2 showing the playyard on the right and the playyard accessory unit on the left.
Figure 4:
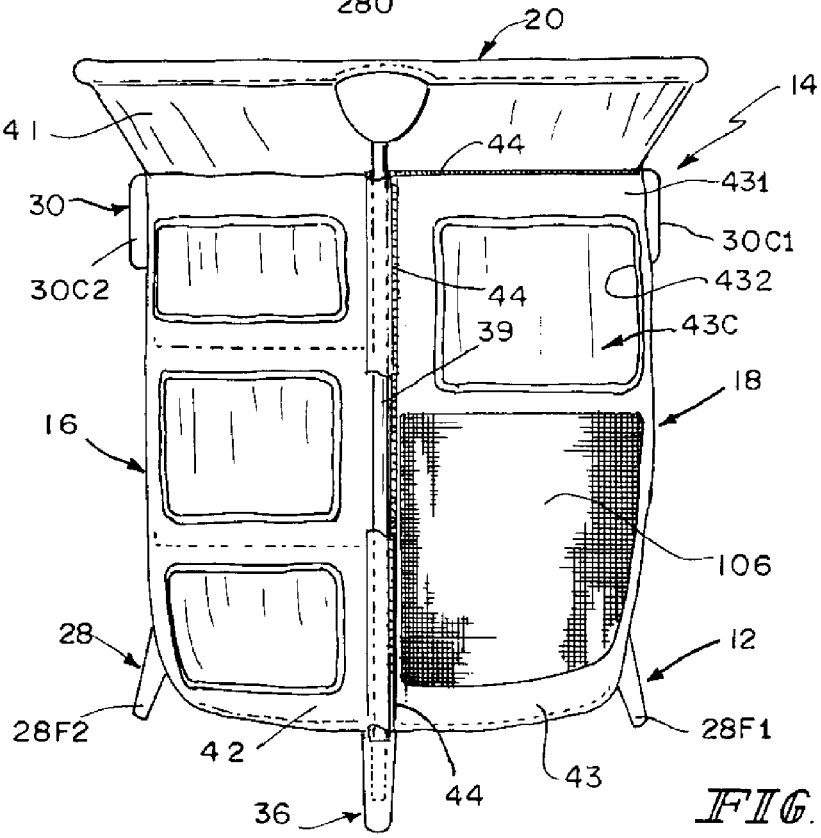
FIG. 4 is an enlarged front view of the infant-care furniture of FIGS. 1-3 showing the storage module on the left; the hamper module on the right, and the infant changer module on top.
Figure 5:
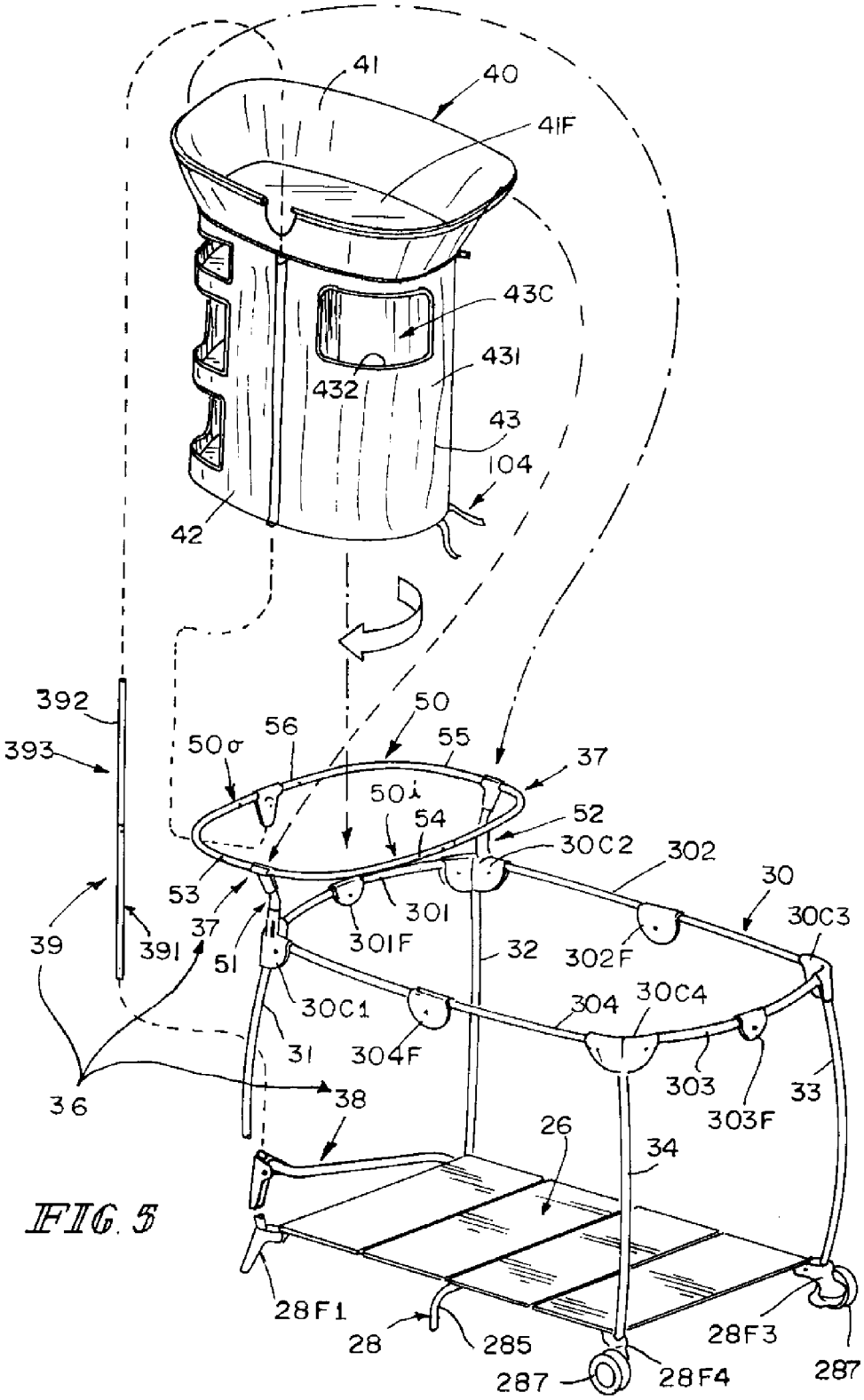
FIG. 5 is an exploded perspective assembly view of the infant-care furniture of FIGS. 1-4 showing the playyard (with the fabric covering omitted), an upper pedestal section and a lower foundation section included in an accessory frame mounted on one end of the playyard, a case made mostly of fabric and configured to include a changer shell, a storage shell, and a hamper shell and an upright auxiliary leg included in the accessory frame but not yet coupled to the case or to the upper pedestal and lower foundation sections.

Playyard 12 includes a playyard frame 22, a fabric cover 24, and a removable floor mat 26 in an illustrative embodiment shown, for example, in FIGS. 1, 2, and 5. Playyard frame 22 includes four corner legs 31, 32, 33, and 34 as shown, for example, in FIG. 5 and is collapsible in the illustrated embodiment. Playyard frame 22 also includes a playyard floor system, or playyard floor support system, 28 coupled to lower ends of corner legs 31, 32, 33, and 34 and a top rail system 30 coupled to upper ends of corner legs 31, 32, 33, and 34 as suggested in FIG. 5. Playyard 12 is formed to include an interior child-receiving region 27 defined, for example, by fabric cover 24 and floor mat 26 as suggested in FIG. 1.

Playyard accessory unit 14 includes an accessory frame 36 and a case 40 coupled to accessory frame 36 to define storage, hamper, and infant changer modules 16, 18, and 20. Accessory frame 36 includes an upper pedestal section 37, a lower foundation section 38, and an auxiliary leg 39 as shown, for example, in FIGS. 5 and 6. Case 40 includes changer, storage, and hamper shells 41, 42, and 43 made of a suitable fabric material and hamper fastener 44 shown illustratively in FIG. 5 and diagrammatically in FIG. 6.

Playyard floor system 28 is shown, for example, in FIG. 2 and includes a rail mount 280, floor support rails 281, 282, 283, and 284, and auxiliary support rails 285, 286. Playyard floor system 28 also includes a first corner foot 28F1, a second corner foot 28F2, a third corner foot 28F3, and a fourth corner foot 28F4 as suggested in FIG. 2. A wheel 287 is coupled to each of third and fourth corner feet 28F3, 28F4 as suggested in FIGS. 2 and 5. Reference is made to U.S. Pat. No. 7,043,779, which patent is hereby incorporated by reference herein, for disclosures relating to playyards and particularly to a collapsible frame of a playyard.

As suggested in FIG. 2, first floor support rail 281 interconnects rail mount 280 and first corner foot 28F1 and second floor support rail 282 interconnects rail mount 280 and second corner foot 28F2. Also, third floor support rail 283 interconnects rail mount 280 and third corner foot 28F2 and fourth floor support rail 284 interconnects rail mount 280 and fourth corner foot 28F4. One end of each of auxiliary support rails 285, 286 is coupled to rail mount 280 as suggested in FIG. 2. Floor mat 26 is configured to lay on top of rail mount 280 and support rails 281-286 as suggested in FIGS. 2 and 5.

Top rail system 30 of playyard 12 includes four corner pieces 30C1, 30C2, 30C3, and 30C4 as suggested in FIG. 5. System 30 also includes a first end rail 301 arranged to interconnect first and second corner pieces 30C1, 30C2, a first side rail 302 arranged to interconnect second and third corner pieces 30C2, 30C3, a second end rail 303 arranged to interconnect third and fourth corner pieces 30C3, 30C4, and a second side rail 304 arranged to interconnect fourth and first corner pieces 30C4, 30C1 as suggested in FIG. 5. Each of end and side rails 301-304 is foldable about a horizontal fold axis extending through a fold unit included in a middle portion of each rail 301-304. Illustrative fold units 301F, 302F, 303F, and 304F are shown in FIG. 5.

Accessory frame 36 of playyard accessory unit 14 is coupled to one end of playyard 12 as suggested in FIG. 5. Accessory frame 36 is configured to provide a framework onto which changer, storage, and hamper shells 41-43 can be draped to form infant changer module 20, storage module 16, and hamper module 18 as suggested in FIGS. 1, 2, 5, and 6.

Upper pedestal section 37 of accessory frame 36 is coupled to top rail system 30 and arranged to extend above playyard 12 as shown, for example, in FIG. 5. Lower foundation section 38 of accessory frame 36 is coupled to playyard floor system 28 and arranged to extend away from playyard 12 to provide a foundation for auxiliary leg 39 as suggested in FIGS. 5 and 6. Auxiliary leg 39 is arranged to extend upwardly from lower foundation section 38 to mate with upper pedestal section 37 and lie outside interior child-receiving region 27 and in spaced-apart relation to playyard 12 as suggested in FIGS. 5, 6, 9, and 10. Auxiliary leg 39 is a steel tube in an illustrative embodiment.

Case 40 of playyard accessory unit 14 is coupled to accessory frame 36 as suggested in FIGS. 2 and 5. Case 40 is configured to include changer shell 41, storage shell 42, and hamper shell 43 as shown illustratively in FIG. 5 and diagrammatically in FIG. 6. Changer shell 41 is coupled to upper pedestal section 37 to define infant changer module 20. Storage shell 42 is coupled to changer shell 41 and located below changer shell 41 to define storage module 16. Hamper shell 43 is coupled to changer shell 41 and located alongside storage shell 42 and below changer shell 41 to define hamper module 18. In an illustrative embodiment, case 40 is configured to allow a caregiver to remove hamper shell 43 from other shells 41, 42 as suggested in FIG. 10 to make it easier to transport laundry items deposited in an article-storage chamber 43C formed in hamper shell 43 to the laundry.

Figure 6:
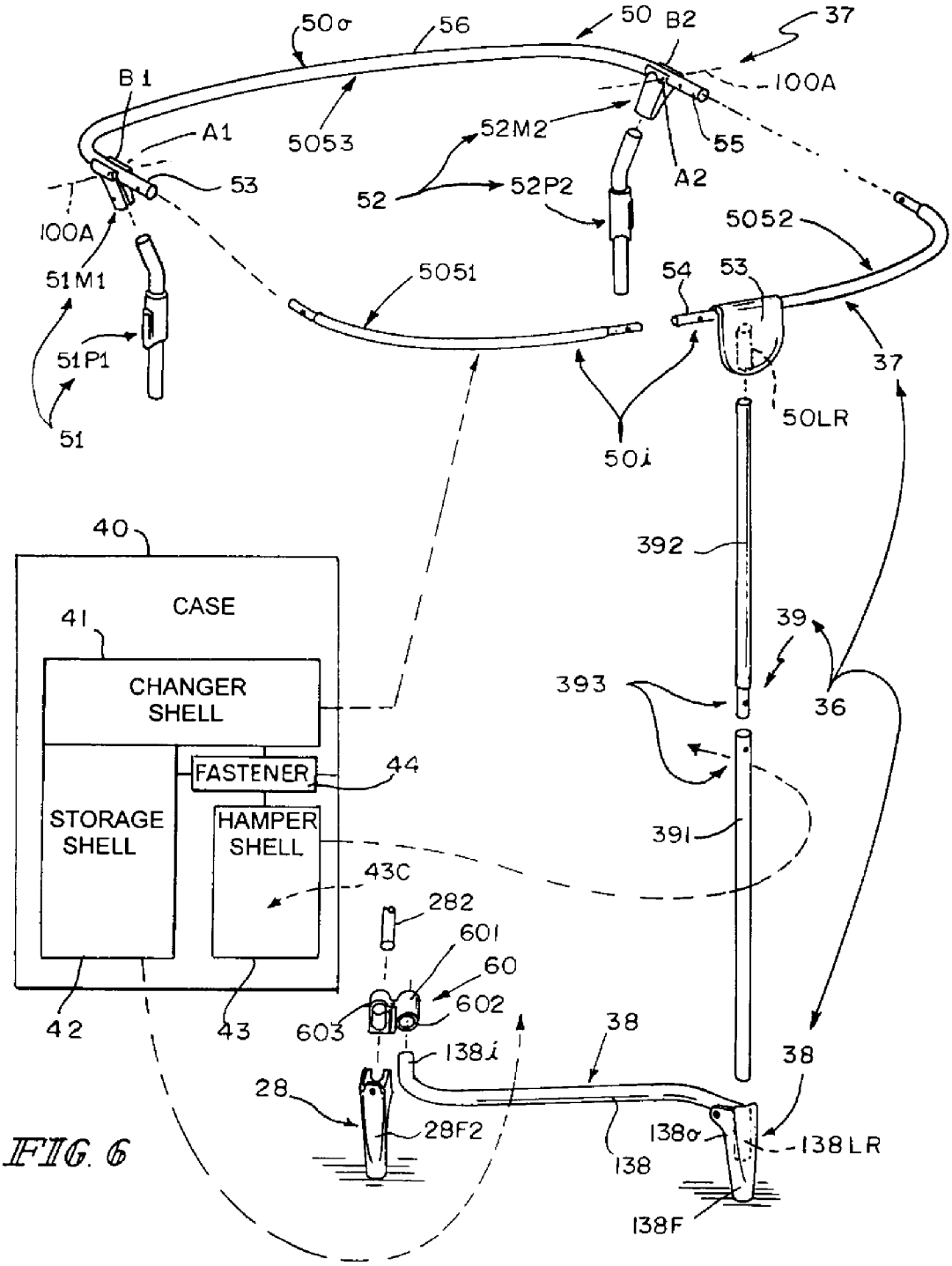
FIG. 6 is an enlarged exploded perspective assembly view of the playyard accessory unit and a portion of the playyard and showing a diagrammatic representation of the case and an illustrative accessory frame configured to support the case and showing that the accessory frame comprises a three-segment changer rim, two short (vertical) changer rim support legs, a much longer (vertical) auxiliary leg, and an S-shaped connector rail adapted to be coupled at a right end thereof to a lower end of the auxiliary leg and a left end thereof to a rail receptacle included in the playyard frame.

Upper pedestal section 37 of accessory frame 36 includes a changer rim 50 and first and second changer rim support legs 51, 52 as shown, for example, in FIGS. 5 and 6. Changer rim 50 is located above playyard frame 22. First changer rim support leg 51 is coupled to first corner piece 30C1 of top rail system 30 and arranged to extend upwardly away from playyard frame 22 and mate with changer rim 50. Second changer rim support leg 32 is coupled to second corner piece 30C2 of top rail system 30 and arranged to extend upwardly away from playyard frame 22 and mate with changer rim 50.

Auxiliary leg 39 is coupled to changer rim 50 and to lower foundation section 38 to retain changer rim 50 in a stationary position relative to playyard frame 22 as suggested in FIGS. 5, 6, 9, and 10. Changer shell 41 is coupled to changer rim 50 to define infant changer module 20 and to support storage and hamper shells 42, 43 alongside playyard 12 to define storage and hamper modules 16, 18.

Changer rim 50 has an oblong shape and includes first and second end rails 53, 55 and first and second side rails 54, 56 as suggested in FIG. 5. First end rail 53 is coupled to first changer rim support leg 51. Second end rail 55 is coupled to second changer rim support leg 52. First side rail 54 is arranged to interconnect first and second end rails 53, 55 and lie over interior child-receiving region 27 formed in playyard frame 22 as suggested in FIGS. 3 and 4. Second side rail 56 is coupled to auxiliary leg 39 and arranged to interconnect first and second end rails 53, 55 and lie in spaced-apart relation to first side rail 54 over lower foundation section 38 of accessory frame 39 as suggested in FIGS. 3 and 4.

The oblong shape of changer rim 50 resembles a clock dial in an illustrative embodiment as suggested in FIG. 5. First changer rim support leg 51 mates with changer rim 50 at about a 6 o'clock position on changer rim 50. Auxiliary leg 39 mates with changer rim 50 at about 9 o'clock position on changer rim 50. Second changer rim support leg 52 mates with changer rim 50 at about a 12 o'clock position on changer rim 50.

Storage shell 42 of case 40 is coupled to auxiliary leg 39 and arranged to extend downwardly from changer shell 41 toward lower foundation section 38 as shown, for example, in FIGS. 4, 5, 9, and 10. Storage shell 42 includes horizontally extending shelves 421, 422, 423 arranged to lie in a second space S2 provided between auxiliary leg 39 and second changer rim support leg 52 as suggested in FIGS. 9 and 10.

Hamper shell 43 is arranged to lie in a first space S1 provided between auxiliary leg 39 and first changer rim support 51. Hamper shell 43 is formed to include an interior region 43C and a front wall 431 of hamper shell 43 is formed to include an aperture opening 432 into interior region 43C of hamper shell 43 as suggested in FIGS. 3-5 and 10.

Figure 10:
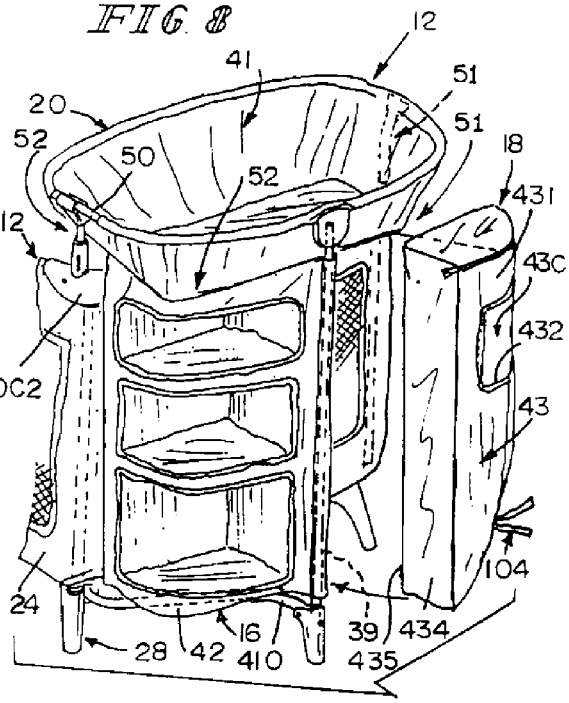

Case 40 is also formed to include hamper-removal means 44 for fastening hamper shell 43 temporarily to changer and storage shells 41, 42 so that hamper shell 43 can be separated from changer and storage shells 41, 42 as suggested in FIG. 10 at the option of a user and removed from the first space S1 provided between auxiliary leg 39 and first changer rim support leg 41 while changer and storage shells 41, 42 remain coupled to accessory frame 36. In illustrative embodiments, hamper-removal means 44 comprises a zipper or other releasable fastener. Zipper 44 can be used in one embodiment to couple hamper shell 43 to both of changer and storage shells 41, 42. In other embodiments, zipper 44 can be used to couple hamper shell 43 to either changer shell 41 or to storage shell 42. It is within the scope of this disclosure to use any suitable releasable fastener in place of zipper 44.

Changer shell 41 includes a floor 41F arranged to lie in a space provided between auxiliary leg 39 and first and second changer rim supports 51, 52. Floor 41F includes an inner portion arranged to lie over playyard floor support system 28 and interior child-receiving region 27 above playyard floor support 28 and an outer portion arranged to lie over lower foundation section 38 of accessory frame 36.

Top rail system 30 includes a first corner piece 30C1 coupled to first changer support rim 51, a second corner piece 30C2 coupled to second changer support rim 52, and an end rail 301 coupled to first and second corner pieces 30C1, 30C2 as shown, for example, in FIG. 5. Changer shell 41 includes a floor 41F arranged to lie over end rail 301 as suggested in FIGS. 5 and 1.

Playyard floor support system 28 includes a first corner foot 28F1 arranged to lie under first corner piece 30C1 and coupled to first corner leg 31. First corner leg 31 is arranged to lie in spaced-apart parallel relation to auxiliary leg 39 and interconnect first corner foot 28F1 and first corner piece 30C1. Second corner foot 28F2 is arranged to lie under second corner piece 30C1 and coupled to second corner leg 32. Second corner leg 32 is arranged to lie in spaced-apart relation to auxiliary leg 39 and interconnect second corner foot 28F2 and second corner piece 30C2. Hamper shell 43 is arranged to lie in a space 51 provided between auxiliary leg 39 and first corner leg 31 as suggested in FIGS. 2 and 9. Storage shell 42 is arranged to lie in a space S2 provided between auxiliary leg 39 and second corner leg 32 as suggested in FIGS. 2 and 9.

Lower foundation section 38 of accessory frame 36 is arranged to lie under storage shell 41. Auxiliary leg 39 is coupled to storage shell 41. Second corner foot 28F2 of playyard floor system 28 is adapted to set on ground underlying playyard 12 and an accessory-frame mount 60 included in playyard floor system 28 associated with second corner foot 28F2. Lower foundation section 38 of accessory frame 36 is coupled to accessory-frame mount 60 and to auxiliary leg 39 and arranged to lie under a portion of changer rim 50 that is coupled to auxiliary leg 39.

Changer rim 50 includes inner and outer portions 50*i*, 50*o* as suggested in FIGS. 5 and 6. Inner portion 50*i* is arranged to lie over playyard floor support system 28 and coupled to first changer rim support leg 51 as suggested in FIG. 5. Outer portion 50*o* is arranged to lie over lower foundation section 38 of accessory frame 36 a suggested in FIG. 5. Each of storage and hamper shells 42, 43 is arranged to lie under outer portion 50*o* of changer rim 50 as suggested in FIG. 3.

Figure 7:
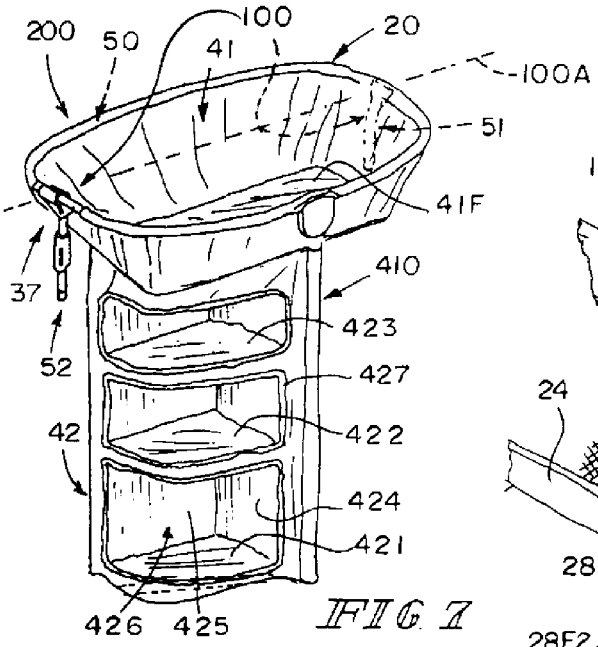
FIGS. 7-10 show an illustrative method of assembling various components to produce a playyard accessory unit mounted on one end of a playyard.
Figure 8:
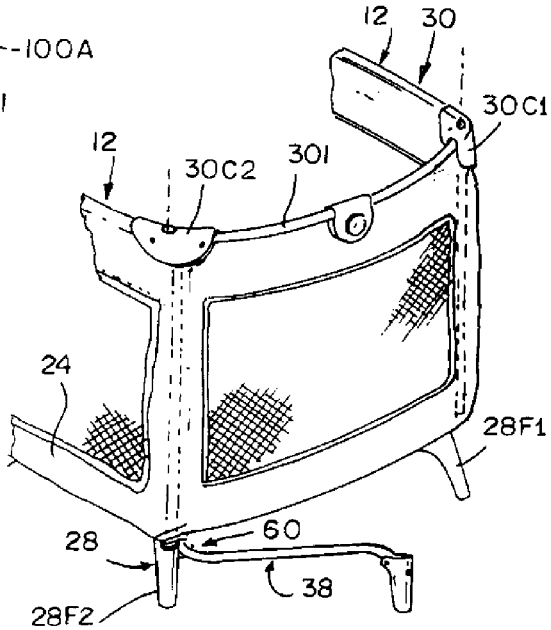
Figure 11:
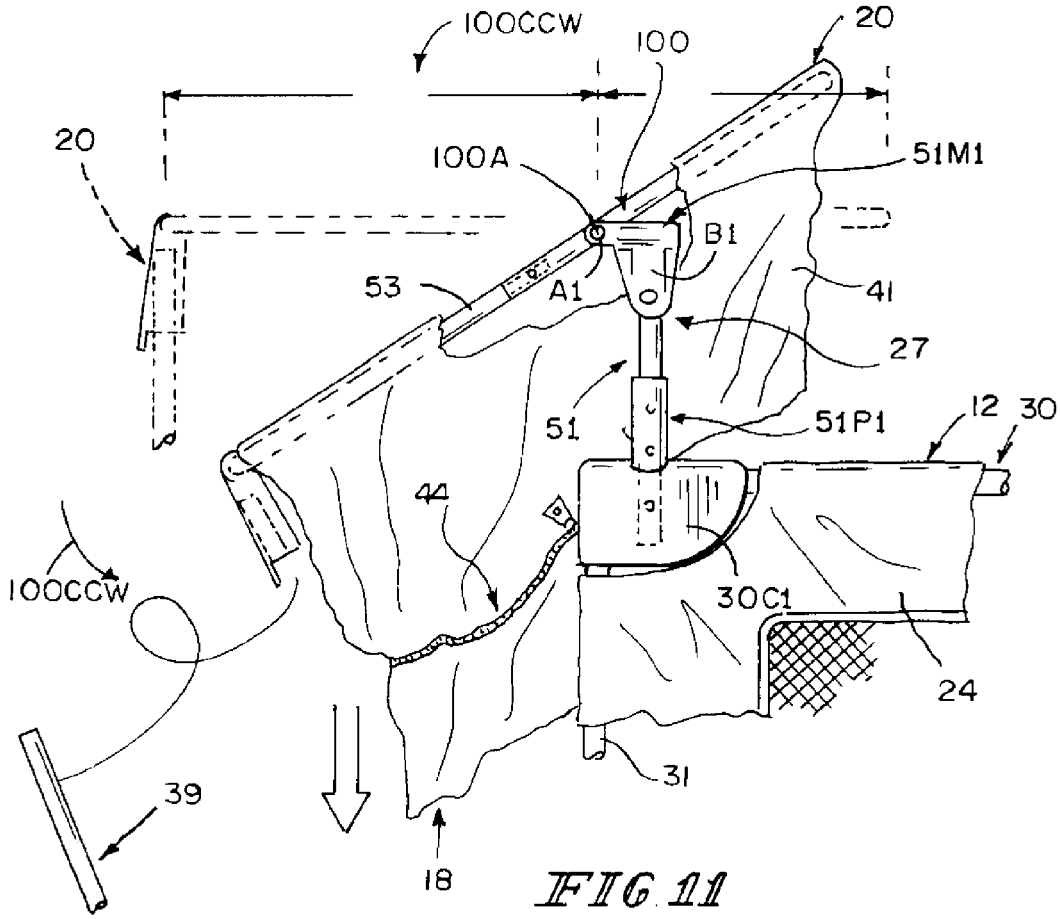
FIG. 11 is an enlarged partial side elevation view of the playyard accessory unit shown in FIG. 3 showing that the changer rim is mounted on the changer rim support legs for pivotable movement about a horizontal pivot axis and showing that the changer rim would pivot in a counterclockwise direction about the horizontal pivot axis if the auxiliary leg is separated from its companion rim mount on the changer rim.

Upper pedestal section 39 of accessory frame 36 includes changer rim 50 located above playyard frame 14 and pivot means for supporting changer rim 50 for pivotable movement about a horizontal pivot axis 100A relative to playyard 12 as suggested in FIGS. 6, 7, and 11. Changer shell 41 is coupled to changer rim 50 to define infant changer module 20. Auxiliary leg 39 is coupled to changer rim 50 as suggested in FIGS. 1, 5, 6, and 11 to block pivotable movement of changer rim 50 about horizontal pivot axis 100A and to support changer shell 41 in a stationary position above playyard 12 and storage and hamper shells 42, 43 alongside the playyard 12. As suggested in FIG. 11, unless auxiliary leg 39 is coupled to changer rim 50, then changer rim 50 will pivot about horizontal pivot axis 100A in counterclockwise direction 100CCW to assume a tilted position in which no infant changer module 20 is defined.

Pivot means 100 includes a first changer rims support leg 51 comprising a first upright pole 51P1 coupled to top rail system 30 and a first rim mount 51M1 coupled to changer rim 50. First rim mount 51M1 is configured to include a first bracket B1 coupled to a free end of first upright pole 51P1 and a first pivot axle A1 coupled to first bracket B1 and to changer rim 50. First pivot axle A1 is arranged to extend along horizontal pivot axis 100A to support changer rim 50 for pivotable movement about horizontal pivot axis 100A.

Pivot means 100 further includes a second changer rim support leg 52 comprising a second upright pole 52P2 coupled to top rail system 30 and a second rim mount 52M2 coupled to changer rim 50. Second rim mount 52M2 is configured to include a second bracket B2 coupled to a free end of second upright pole 52P2 and a second pivot axle A2. Second pivot axle A2 is coupled to second bracket B2 and to changer rim 50 and arranged to extend along horizontal pivot axis 100A to support changer rim 50 for pivotable movement about horizontal pivot axis 100. First corner piece 30C1 of top rail system 30 is coupled to first rim mount 51M1 of first changer rim support leg 51. Second corner piece 30C2 of top rail system 30 is coupled to second rim mount 52M2 of second changer rim support leg 52. End rail 301 of top rail system 30 is arranged to interconnect the first and second corner pieces 30C1, 30C2 and to lie under a floor 41F of cradle shell 41.

Storage shell 42 is formed to include horizontally extending shelves 421, 422, 423 as suggested in FIGS. 1 and 7. Each of shelves 421-423 is coupled to rectangular side and back walls 424, 425 of storage shell 42. A front aperture 426 formed in a front wall 427 of storage shell 42 is arranged to open into an interior region 427 formed in storage shell 42 to contain shelves 421-423 therein as suggested in FIG. 9.

Figure 9:
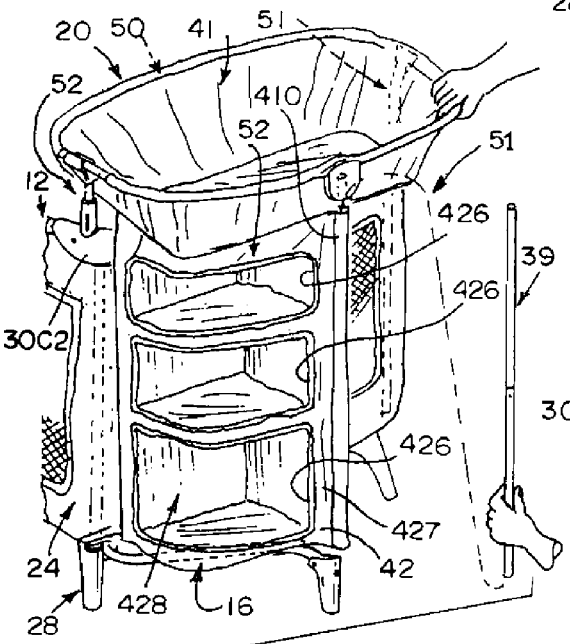

Storage shell 42 has an upright quarter-round shape characterized by a pie-shaped floor 421 defining a quarter section of a circle, a curved outer front wall 427 facing away from playyard 12, a rectangular back wall 425 facing toward playyard 12, and a rectangular side wall 424 as suggested in FIGS. 1, 7, and 9. Hamper shell 43 has an upright quarter-round shape characterized by a pie-shaped floor 431 defining a quarter section of a circle, a curved outer front wall 431 facing away from the playyard, a rectangular back wall 435 facing toward the playyard, and a rectangular side wall 434 as suggested in FIGS. 2 and 10. Rectangular side wall 424 of storage shell 42 is arranged to face toward and lie in confronting relation to rectangular side wall of hamper shell 43 as suggested in FIGS. 2 and 10. Rectangular side wall 424 of storage shell 42 is arranged to face toward and lie in confronting relation to rectangular side wall of hamper shell 43.

As suggested in FIG. 6, accessory-frame mount 60 of playyard floor system 28 includes a rail receptacle 601 formed to include a rail-receiver passageway 602. Rail receptacle 601 is coupled to a foot receiver 603 sized to receive and mate with second corner foot 28F2 and with floor support rail 282.

Assembly of components included in accessory frame 36 is shown, for example, in FIG. 6. An inner end 138*i* of an S-shaped connector rail 138 included in lower foundation section 38 is inserted into rail-receiver passageway 602 of rail receptacle 601 and retained in place using, for example, a valco pin. An outer end 138*o* of S-shaped connector rail 138 is coupled to a foot 138F included in lower foundation section 38 to mate lower foundation section to playyard 12 as suggested in FIG. 8.

Auxiliary leg 39 includes a lower rod 391, an upper rod 392, and a rod retainer 392 configured to define means for retaining upper rod 392 in fixed in-line relation to lower rod 391 as suggested in FIGS. 5 and 6. Lower rod 391 is configured to mate with a lower leg receiver 138LR formed in auxiliary foot 138F. Upper rod 392 is configured to extend into upper leg receiver 50LR formed in changer rim 50.

In an illustrative embodiment, changer rim 50 includes an outer segment 50S3 providing one-half of changer rim 50, a first inner segment 50S1 providing one-quarter of changer rim 50, and a second inner segment 50S2 providing one-quarter of rim changer 50 as suggested in FIG. 56. Changer rim 50 also includes a third rim mount 53 formed to include an upper leg receiver 50LR and coupled to second inner segment 50S2 and configured to receive and mate with auxiliary leg 39 as suggested in FIG. 6.

An illustrative method of assembling various components to produce a playyard accessory unit 14 mounted on one end of playyard 12 is shown in FIGS. 7-10. Changer shell 41 included in case 40 is mounted on changer rim 50 to produce a subassembly 200 shown in FIG. 7. The S-shaped connector rail 138 of lower foundation section 38 is then coupled to playyard 12 by inserting the left end of connector rail 138 into rail-receiving passageway 602 of the rail receptacle 601 that is included in playyard frame 22 and located near second corner foot 28F2 included in playyard frame 22 as suggested in FIGS. 6 and 8. Then subassembly 200 is moved by the caregiver to cause first and second changer rim support legs 51, 52 coupled to changer rim 50 to be mounted on corner pieces included in a top rail system 30 of a companion playyard 12 so that storage shell 42 is arranged to hang downwardly from an underside of changer shell 41 as shown, for example, in FIG. 9.

The next step in the assembly process is to install auxiliary leg 39 as suggested in FIG. 9. A portion of accessory frame 136 has been mounted on first and second corner pieces 30C1, 30C2 included in top rail system 30 provided in playyard frame 22 to position changer and storage shells 41, 42 alongside one end of playyard 12. The caregiver then holds infant changer module 20 in a level orientation with one hand while inserting auxiliary leg 30 into a sleeve 410 formed in storage shell 41 with the other hand. Then, a lower end of auxiliary leg 39 is inserted into lower leg receiver 138LR formed in auxiliary foot 138F coupled to the right end of S-shaped connector rail 138 and an upper end of auxiliary leg 139 is inserted into upper leg receiver 50LR formed in third rim mount 53 included in changer rim 50 so that auxiliary leg 39 is installed to complete assembly of accessory frame 36 and to hold infant changer module 20 in a level orientation.

Removable hamper shell 43 then can be coupled to changer and storage shells 41, 42 at this stage of assembly using a zipper-style fastener 44. Hamper shell 43 can also be coupled to changer and storage shells 41, 42 at the stage shown in FIG. 7. Various tie-down straps 104 can be used to tether hamper shell 43 to accessory frame 36 or other portions of furniture 10. A basket 106 made of netting material can be provided on hamper shell 43 as illustrated to provide further storage as shown, for example, in FIGS. 3 and 4.

The invention claimed is:

1. Infant-care furniture comprising a playyard including a playyard frame including a playyard floor system, a top rail system located above the playyard floor system, and corner legs arranged to extend upwardly from the playyard floor system to the top rail system and a covering coupled to the playyard frame and formed to define an interior child-receiving region above the playyard floor system, and a playyard accessory unit coupled to the playyard frame and formed to include storage, hamper, and infant changer modules, wherein the playyard accessory unit includes an accessory frame including a lower foundation section coupled to the playyard floor system and arranged to extend away from the playyard, an upper pedestal section coupled to the top rail system and arranged to extend above the playyard, and an auxiliary leg arranged to extend upwardly from the lower foundation section to the upper pedestal section and lie outside the interior child-receiving region and in spaced-apart relation to the playyard and the playyard accessory unit further includes a case coupled to the accessory frame and configured to include a changer shell coupled to the upper pedestal section to define the infant changer module, a storage shell coupled to the changer shell and located below the changer shell to define the storage module, and a hamper shell coupled to the changer shell and located alongside the storage shell and below the changer shell to define the hamper module.

2. The infant-care furniture of claim 1, wherein the upper pedestal section of the accessory frame includes a changer rim located above the playyard frame and a first changer rim support leg coupled to the top rail system and arranged to extend upwardly away from the playyard frame and mate with the changer rim, the auxiliary leg is coupled to the changer rim to retain the changer rim in a stationary position relative to the playyard frame, and the changer shell is coupled to the changer rim to define the infant changer module and to support the storage and hamper shells alongside the playyard.

3. The infant-care furniture of claim 2, wherein the upper pedestal section further includes a second changer rim support leg coupled to the top rail system and arranged to extend upwardly away from the playyard frame and mate with the changer rim.

4. The infant-care furniture of claim 3, wherein the changer rim has an oblong shape and includes a first end rail coupled to the first changer rim support leg, a second end rail coupled to the second changer rim support leg, a first side rail arranged to interconnect the first and second end rails and lie over the interior child-receiving region formed in the playyard frame, and a second side rail coupled to the auxiliary leg and arranged to interconnect the first and second end rails and lie in spaced-apart relation to the first side rail over the lower foundation section of the accessory frame.

5. The infant-care furniture of claim 4, wherein the top rail system includes first, second, third, and fourth corner pieces, and four rails, each rail interconnects two of the first, second, third, and fourth corner pieces, the first changer rim support leg is coupled to the first corner piece, and the second changer rim support leg is coupled to the second corner piece.

6. The infant-care furniture of claim 4, wherein the storage shell of the case is coupled to the auxiliary leg and arranged to extend downwardly from the changer shell toward the lower foundation section.

7. The infant-care furniture of claim 3, wherein the changer rim has an oblong clock-dial shape, the first changer rim support leg mates with the changer rim at about a 6 o'clock position on the changer rim, the auxiliary leg mates with the changer rim at about 9 o'clock position on the change rim, and the second changer rim support leg mates with the changer rim at about a 12 o'clock position on the changer rim.

8. The infant-care furniture of claim 7, wherein the playyard floor system includes a corner foot adapted to set on ground underlying the playyard and an accessory-frame mount associated with the corner foot and the lower foundation section of the accessory frame is coupled to the accessory-frame mount and to the auxiliary leg and arranged to lie under a portion of the changer rim coupled to the auxiliary leg.

9. The infant-care furniture of claim 3, wherein the hamper shell is arranged to lie in a first space provided between the auxiliary leg and the first changer rim support leg and the storage shell includes at least one horizontally extending shelf arranged to lie in a second space provided between the auxiliary leg and the second changer rim support leg.

10. The infant-care furniture of claim 3, wherein the case is formed to include hamper-removal means for fastening the hamper shell temporarily to the changer and storage shells so that the hamper shell can be separated from the changer and storage shells at the option of a user and removed from the first space provided between the auxiliary leg and the first changer rim support leg while the changer and storage shells remain coupled to the accessory frame.

11. The infant-care furniture of claim 3, wherein the changer shell includes a floor arranged to lie in a space provided between the auxiliary leg and the first and second changer rim supports and the floor includes an inner portion arranged to lie over the playyard floor support system and the interior child-receiving region above the playyard floor support and an outer portion arranged to lie over the lower foundation section of the accessory frame.

12. The infant-care furniture of claim 3, wherein the top rail system includes a first corner piece coupled to the first changer support rim, a second corner piece coupled to the second changer support rim, and an end rail coupled to the first and second corner pieces, and the changer shell includes a floor arranged to lie over the end rail.

13. The infant-care furniture of claim 12, wherein the playyard floor support system includes a first corner foot arranged to lie under the first corner piece and coupled to a first of the corner legs arranged to lie in spaced-apart parallel relation to the auxiliary leg and interconnect the first corner foot and the first corner piece and a second corner foot arranged to lie under the second corner piece and coupled to a second of the corner legs arranged to lie in spaced-apart relation to the auxiliary leg and interconnect the second corner foot and the second corner piece, the hamper shell is arranged to lie in a space provided between the auxiliary leg and the first of the corner legs, and the storage shell is arranged to lie in a space provided between the auxiliary leg and the second of the corner legs.

14. The infant-care furniture of claim 2, wherein the lower foundation section of the accessory frame is arranged to lie under the storage shell.

15. The infant-care furniture of claim 14, wherein the auxiliary leg is coupled to the storage shell.

16. The infant-care furniture of claim 14, wherein the playyard floor system includes a corner foot adapted to set on ground underlying the playyard and an accessory-frame mount associated with the corner foot and the lower foundation section of the accessory frame is coupled to the accessory-frame mount and to the auxiliary leg and arranged to lie under a portion of the changer rim coupled to the auxiliary leg.

17. The infant-care furniture of claim 2, wherein the changer rim includes an inner portion arranged to lie over the playyard floor support system and coupled to the first changer rim support leg and an outer portion arranged to lie over the lower foundation section of the accessory frame and each of the storage and hamper shells is arranged to lie under the outer portion of the changer rim.

18. The infant-care furniture of claim 17, wherein the case is formed to include hamper-removal means for fastening the hamper shell temporarily to the changer and storage shells so that the hamper shell can be separated from the changer and storage shells at the option of a user and removed from a space provided between the auxiliary leg and the first changer rim support leg while the changer and storage shells remain coupled to the accessory frame.

19. The infant-care furniture of claim 1, wherein the upper pedestal section of the accessory frame includes a changer rim located above the playyard frame and pivot means for supporting the changer rim for pivotable movement about a horizontal pivot axis relative to the playyard, the changer shell is coupled to the changer rim to define the infant changer module, and the auxiliary leg is coupled to the changer rim to block pivotable movement of the changer rim about the horizontal pivot axis and to support the changer shell in a stationary position above the playyard and the storage and hamper shells alongside the playyard.

20. The infant-care furniture of claim 19, wherein the pivot means includes a first changer rim support leg comprising a first upright pole coupled to the top rail system and a first rim mount coupled to the changer rim and configured to include a first bracket coupled to a free end of the first upright pole and a first pivot axle coupled to the first bracket and to the changer rim and arranged to extend along the horizontal pivot axis to support the changer rim for pivotable movement about the horizontal pivot axis.

21. The infant-care furniture of claim 20, where the pivot means further includes a second changer rim support leg comprising a second upright pole coupled to the top rail system and a second rim mount coupled to the changer rim and configured to include a second bracket coupled to a free end of the second upright pole and a second pivot axle coupled to the second bracket and to the changer rim and arranged to extend along the horizontal pivot axis to support the changer rim for pivotable movement about the horizontal pivot axis, the top rail system includes a first corner coupled to the first rim mount of the first changer rim support leg, a second corner coupled to the second rim mount of the second changer rim support leg, and an end rail arranged to interconnect the first and second corners and to lie under a floor of the cradle shell.

22. The infant-care furniture of claim 19 wherein the playyard floor system includes a first corner foot arranged to lie under the first corner piece and coupled to a first of the corner legs arranged to lie in spaced-apart parallel relation to the auxiliary leg and interconnect the first corner foot and the first corner piece and a second corner foot arranged to lie under the second corner piece and coupled to a second of the corner legs arranged to lie in spaced-apart relation to the auxiliary leg and interconnect the second corner foot and the second corner piece, the hamper shell is arranged to lie in a space provided between the auxiliary leg and the first of the corner legs, and the storage shell is arranged to lie in a space provided between the auxiliary leg and the second of the corner legs.

23. The infant-care furniture of claim 19, wherein the lower foundation section of the accessory frame is arranged to lie under the storage shell.

24. The infant-care furniture of claim 19, wherein the auxiliary leg is coupled to the storage shell.

25. The infant-care furniture of claim 1, wherein the storage shell of the case is coupled to the auxiliary leg and arranged to extend downwardly from the changer shell toward the lower foundation section.

26. The infant-care furniture of claim 25, wherein the case is formed to include hamper-removal means for fastening the hamper shell temporarily to the changer and storage shells so that the hamper shell can be separated from the changer and storage shells at the option of a user.

27. The infant-care furniture of claim 1, wherein each of the storage and hamper shells has an upright quarter-round shape characterized by a pie-shaped floor defining a quarter section of a circle, a curved outer front wall facing away from the playyard, a rectangular back wall facing toward the playyard, and a rectangular side wall and the rectangular side wall of the storage shell is arranged to face toward and lie in confronting relation to the rectangular side wall of the hamper shell.

28. The infant-care furniture of claim 27, wherein the storage shell is formed to include at least one horizontally extending shelf coupled to the rectangular side and back walls of the storage shell and a front aperture in the front wall of the storage shell opening into an interior region formed in the storage shell and containing the at least one horizontally extending shelf therein.

29. The infant-care furniture of claim 28, wherein the hamper shell is formed to include an interior region and the front wall of the hamper shell is formed to include an aperture opening into the interior region of the hamper shell.

30. The infant-care furniture of claim 29, wherein the case is formed to include hamper-removal means for fastening the hamper shell temporarily to the changer and storage shells so that the hamper shell can be separated from the changer and storage shells at the option of a user.

31. The infant-care furniture of claim 27, wherein the hamper shell is formed to include an interior region and the front wall of the hamper shell is formed to include an aperture opening into the interior region of the hamper shell.

32. The infant-care furniture of claim 31, wherein the case is formed to include hamper-removal means for fastening the hamper shell temporarily to the changer and storage shells so that the hamper shell can be separated from the changer and storage shells at the option of a user.

* * * * *